US009230484B2

(12) United States Patent
Leung et al.

(10) Patent No.: US 9,230,484 B2
(45) Date of Patent: Jan. 5, 2016

(54) ADAPTIVE BACKLIGHT CONTROL AND CONTRAST ENHANCEMENT

(75) Inventors: Charles Leung, North York (CA); Jatin Naik, Brampton (CA); Lawrence Lim, Calgary (CA); Laurent Dahan, Helsinki (FI); Milivoje Aleksic, Richmond Hill (CA)

(73) Assignee: ATI TECHNOLOGIES ULC, Markham (CA)

( * ) Notice: Subject to any disclaimer, the term of this patent is extended or adjusted under 35 U.S.C. 154(b) by 2209 days.

(21) Appl. No.: 12/203,254

(22) Filed: Sep. 3, 2008

(65) Prior Publication Data

US 2010/0053061 A1 Mar. 4, 2010

(51) Int. Cl.
*G09G 3/36* (2006.01)
*G09G 3/34* (2006.01)

(52) U.S. Cl.
CPC ..... *G09G 3/3406* (2013.01); *G09G 2320/064* (2013.01); *G09G 2360/16* (2013.01)

(58) Field of Classification Search
CPC ..... G09G 3/3406–3/3426; G09G 2320/0626–2320/066; G09G 2360/16
USPC ..... 345/87–102, 204, 690
See application file for complete search history.

(56) References Cited

U.S. PATENT DOCUMENTS

| | | | | |
|---|---|---|---|---|
| 7,515,765 | B1 * | 4/2009 | MacDonald et al. | 382/263 |
| 2004/0013298 | A1 * | 1/2004 | Choe et al. | 382/167 |
| 2004/0120599 | A1 | 6/2004 | Henley | |
| 2006/0071899 | A1 | 4/2006 | Chang et al. | |
| 2006/0238487 | A1 * | 10/2006 | Shih | 345/102 |
| 2006/0269125 | A1 | 11/2006 | Kalevo et al. | |
| 2007/0002004 | A1 * | 1/2007 | Woo | 345/102 |
| 2007/0024582 | A1 | 2/2007 | Kamimura | |
| 2007/0229466 | A1 * | 10/2007 | Peng et al. | 345/173 |

FOREIGN PATENT DOCUMENTS

EP 1840867 A2 10/2007

OTHER PUBLICATIONS

Ali Iranli et al., "Power Aware Mobile Displays", Jul. 26, 2006, Department of Electrical Engineering University of Southern California, 20 Slides.

(Continued)

*Primary Examiner* — Stephen Sherman

(57) ABSTRACT

A transform function represented by at least n points that define n−1 regions is determined based at least in part on a first set of values associated with a display frame and a maximum average contrast function. The n points can be determined in response to a change in an average contrast of the display frame compared to an average contrast of a previous display frame exceeding a predetermined threshold. The first set of values is converted to a corresponding second set of values based on the transform function. A backlight control signal is generated based on an average contrast of the second set of values, whereby the backlight control signal is configured to control an intensity of a backlight of a display. Further, a video signal is generated based on the second set of values, whereby the video signal configured to drive the display.

20 Claims, 7 Drawing Sheets

(56) References Cited

OTHER PUBLICATIONS

Liang Cheng et al., "Quality Adapted Backight Scaling (QABS) for Video Streaming to Mobile Handheld Devices", Donald Bren School of Information and Computer Sciences, University of California, Irvine, CA 92697, USA, 9 pages.

Ali Iranli et al., "HEBS: Histogram Equalization for Backlight Scaling", Proceedings of the Design, Automation and Test in Europe Conference and Exhibition (2005), 1530-1591/05 IEEE, 6 pages.

* cited by examiner

ADAPTIVE BACKLIGHT CONTROL AND CONTRAST ENHANCEMENT

FIELD OF THE DISCLOSURE

The present disclosure relates generally to display processing and more particularly to contrast enhancement and backlight control.

BACKGROUND

A number of display architectures, such as the liquid crystal display (LCD) architecture, make use of backlighting to facilitate display of images (still images or video) at a display device. In portable display devices, such as personal digital assistants, cellular phones, and notebook computers, powering the backlight subsystem can constitute a significant portion (e.g. 40%) of the total power consumption of the display device, thereby significantly impacting the total operating time for a given battery power capacity. Accordingly, various conventional techniques have been implemented in an effort to reduce the power consumed by backlighting. While these conventional techniques often reduce the power consumed by backlighting, it typically is at the expense of display fidelity. One conventional technique includes simply reducing the backlight intensity while increasing the LCD transmittance. This adaptation, however, detrimentally impacts the contrast of the displayed image. Another conventional technique, histogram stretching, attempts to salvage image contrast while reducing backlight intensity by setting thresholds at the brightest and darkest regions of the image. This process, however, leads to distortion in the pixels in both the brightest and darkest regions. Accordingly, an improved technique for enhancing image contrast so as to facilitate use of a lower backlight intensity level would be advantageous.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION OF THE FIGURES

FIGS. 1-8 illustrate example techniques for enhanced image contrast to facilitate adaptive backlight control for reduced power consumption. In at least one embodiment, a display system analyzes the pixel data for a display frame (or a portion thereof) to generate a transform function having n points (n>2) that represent or define n−1 regions of the transform function. The display system then applies the transform function to pixel values of the display frame to generate a modified display frame. The display system can determine the average contrast and average brightness of the resulting display frame and adjust the intensity of a backlight accordingly.

For ease of discussion, the techniques of the present disclosure are described in the example context of a transform function having five points that define four regions. Because the fifth point is set to the maximum value for both the input and output and thus does not require computation, this transform is referred to herein as a "four-point transform function" to reflect the four points that require some degree of calculation. Although these techniques are described in the context of a four-point transform function, these techniques can be adapted to implement other n-point transform functions (e.g., three-point transform functions, five-point transform functions, etc.) without departing from the scope of the present disclosure.

Figure 1:
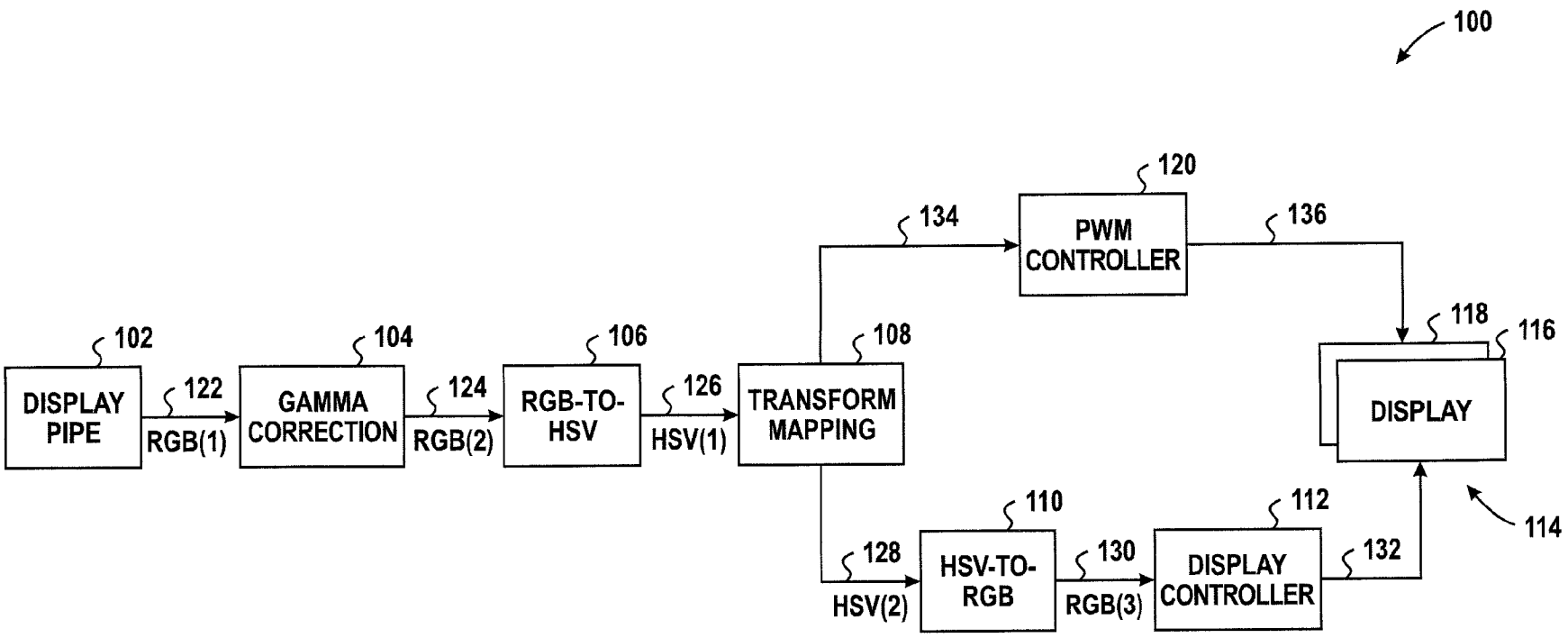
FIG. 1 is a block diagram illustrating a display system in accordance with at least one embodiment of the present disclosure.
Figure 2:
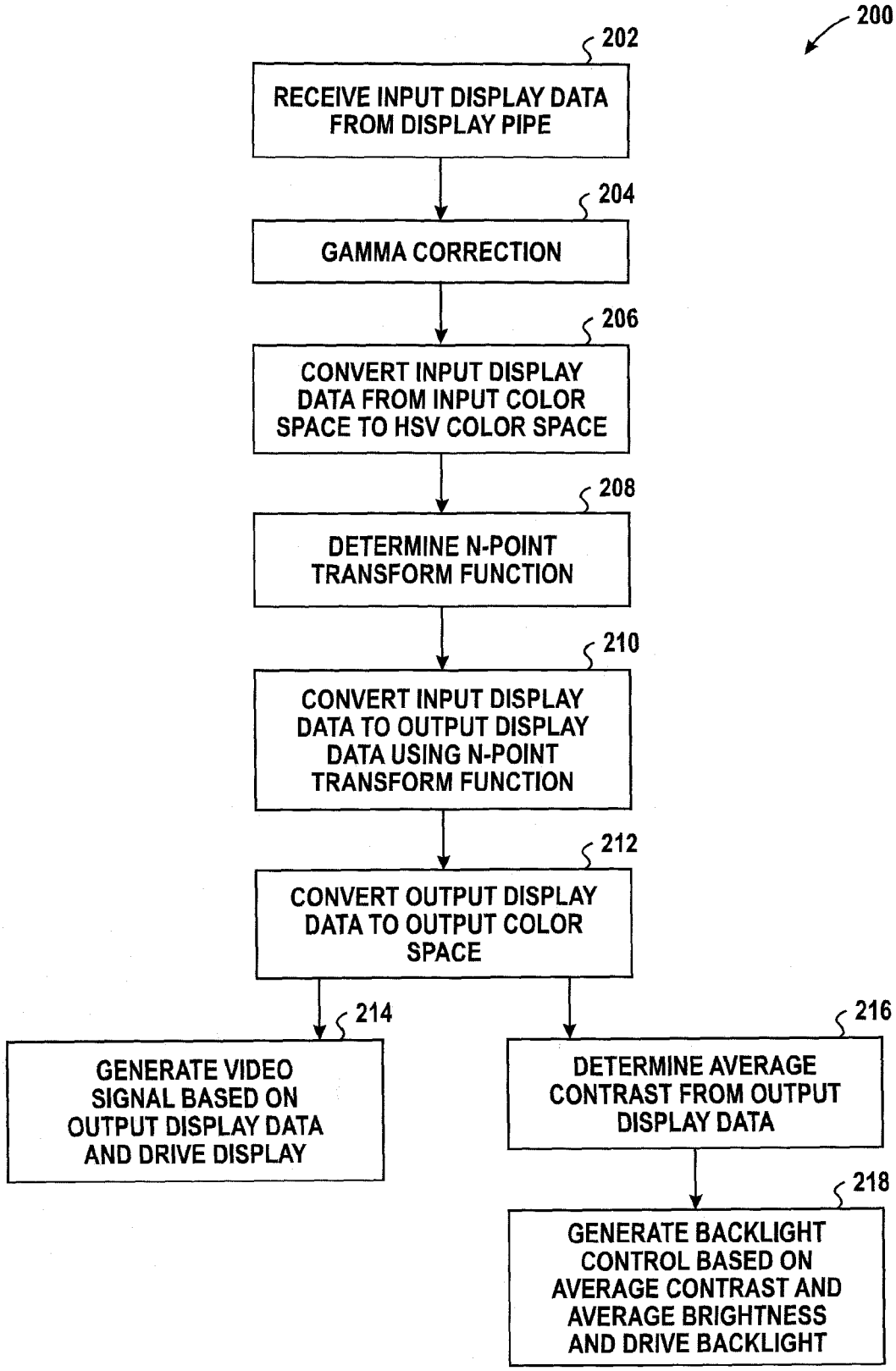
FIG. 2 is a flow diagram illustrating a method for enhancing a contrast of an image for output to a display and adapting a backlight intensity based on the enhanced contrast in accordance with at least one embodiment of the present disclosure.

FIG. 1 illustrates a display system 100 having enhanced image contrast so as to facilitate adaptive backlight control and FIG. 2 illustrates an example method 200 of its operation in accordance with at least one embodiment of the present disclosure. In the depicted example, the display system 100 includes a display pipe 102, a gamma correction module 104, a color space converter 106, a n-point mapping module 108, a color space converter 110, a display controller 112, a display device 114 comprising a display 116 and a backlight 118, and a backlight controller 120 (illustrated as a pulse width modulation (PWM)-based controller). The functionality of the various components 102, 104, 106, 108, 110 and 120 can be implemented as hardware, firmware, software-based execution, or a combination thereof. To illustrate, the functions of certain components can be implemented as discrete logic, an application specific integrated circuit (ASIC), a field programmable gate array (FPGA), and the like, while other functions of certain components can be implemented based on software instructions executed by one or more processors of a processing system. Further, some or all of the components can implemented in a processing device designed based on a set of register-transfer-level (RTL) or Verilog instructions that define the functionality of the processing device and which are synthesized to generate the electrical and electronic design of the processing device.

The display pipe 102 is configured to process image data to generate display data and can include any of a variety of video decoders, formatters, encoders, renderers, and the like. The gamma correction module 104 is configured to perform one or more gamma correction processes on received display data. The color space converters 106 and 110 are configured to convert display data from a respective input color space to a respective output color space. The n-point mapping module 108 is configured to generate an n-point transform function (n>2) and then apply the n-point transform function to an input display data so as to enhance the contrast of the display data. The display controller 112 is configured to receive display data and drive one or more output signals based on the display data so as to manipulate the display 116 of the display device 114 to display a corresponding set of pixels of a display frame represented by the display data. The backlight controller 120 is configured to control the backlight 118 of the display device 114 based on the average contrast of the display data generated by the n-point mapping module 108.

An example operation of the display system 100 of FIG. 1 is illustrated by method 200 of FIG. 2. At block 202 the display pipe 102 receives image data, such as, for example, video data encoded in accordance with a Motion Pictures Experts Group (MPEG) specification or still image data encoded in accordance with a Joint Pictures Experts Group (JPEG) specification, and processes the image data (e.g., via decoding, rendering, etc.) to generate display data 122 (also identified herein as RGB(1) data) representative of a corresponding set of pixels of at least a portion of a display frame to be displayed at the display device 114. For the following example, it is assumed that the display data 122 is represented in a Red-Blue-Green (RGB) color space, although other color spaces (e.g., YCrCb) can be used without departing from the scope of the present disclosure. At block 204, the gamma correction module 104 performs one or more gamma correction processes or other image enhancement processes using the set of display data 122 to generate a set of display data 124 (also identified herein as RGB(2) data) for the corresponding pixels of display frame.

As described in detail below, the display data used to drive the display 114 is contrast enhanced to facilitate adaptive backlight control to reduce power consumption while maintaining acceptable image quality. In one embodiment, the contrast enhancement is achieved in part via an n-point transform function having characteristics that can be advantageously identified based on an analysis of the display data in the Hue Saturation Value (HSV) color space. The HSV color space describes colors as points in a cylinder whose central axis ranges from black at the bottom to white at the top with neutral colors between them, whereby the angle around the axis corresponds to "hue", the distance from the axis corresponds to "saturation", and distance along the axis corresponds to "value" (also described as "lightness" or "brightness"). Accordingly, in the event that the display data 124 is in a color space other than HSV (in the illustrated example, the display data 124 is in the RGB color space), at block 206 the color space converter 106 converts the display data 124 to the HSV color space using any of a variety of RGB-to-HSV transforms, to generate corresponding display data 126 (also identified herein as "HSV(1) display data") in the HSV color space.

At block 208, the n-point mapping module 108 generates an n-point transform function based on the display data 126 generated for the current display frame to be displayed, based on the display data generated for one or more previous display frames that were displayed, or a combination thereof. After generating the n-point transform function, at block 210 the n-point mapping module 108 applies the n-point transform function to the display data 126 to generate a display data 128 (also identified as "HSV(2) display data"). As described in greater detail below with reference to FIG. 7, the same n-point transform function can be used for a series of display frames until a change in the average contrast from one input display frame to the next input display frame exceeds a threshold, thereby triggering the determination of a new n-point transform function to be applied. An example of the n-point transform function is described below with reference to FIG. 3, and example methods for determining the example n-point transform function and for applying the n-point transform function to convert display data are described below with reference to FIGS. 4-7.

It will be appreciated that the display controller 112 and display device 114 are configured to operate on display data having a particular color space. For example, many display devices operate on display data in the RGB color space. Accordingly, in one embodiment, at block 212 the color space converter 110 converts the display data 128 to the RGB color space of the display device 114 using any of a variety of HSV-to-RGB transforms to generate corresponding display data 130 (also identified herein as "RGB(3) display data") in the RGB color space. At block 214, he display controller 112 generates one or more video signals 132 based on the display data 130 so as to drive the display 116 of the display device 114 to display the corresponding set of pixels of the display frame.

As noted above, the transform process performed by the n-point mapping module 108 at block 210 enhances the contrast of the image represented by the output display data 128, thereby allowing a reduction in the backlight intensity of the backlight 118 during the display of the image without incurring a significant reduction in displayed image quality. Accordingly, at block 216 the n-point mapping module 108 determines the average contrast of the image represented by the output display data 128 and provides a backlight control signal 134 based on the determined average contrast. In one embodiment, the backlight control signal 134 can be used to directly control the intensity level of the backlight 118. However, in another embodiment, the backlight control signal 134 is provided to the backlight controller 120 and at block 218, the backlight controller 120 configures a PWM-controlled backlight control signal 136 based on the backlight control signal 134 so as to control the intensity of the backlight 118 of the display device 114. As discussed in greater detail with reference to FIG. 7, the backlight controller 120 (or alternately the n-point mapping module 108) can determine a new or updated brightness level based on the n-point transform function and then gradually adjust the intensity of the backlight over a predetermined duration or predetermined number of display frames so as to reduce the potential for flickering that might otherwise occur if the backlight intensity were changed rapidly for each display frame.

Figure 3:
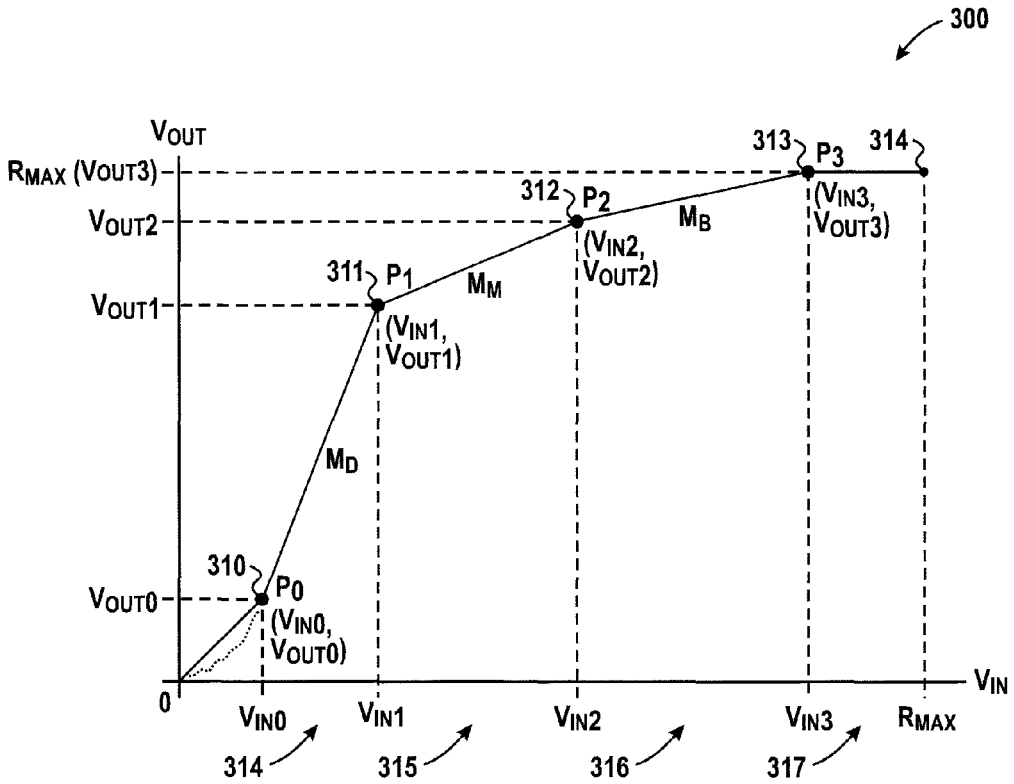
FIG. 3 is graph illustrating a four point transform function in accordance with at least one embodiment of the present disclosure.

FIG. 3 illustrates a graph 300 depicting an example four point transform function 302 determined and utilized by the n-point mapping module 108 of FIG. 1 in accordance with at least one embodiment of the present disclosure. The four point transform function 302 represents a mapping of each input V value ($V_{in}$) of the HSV triplets representing pixels of the input display data 126 to a corresponding output V value ($V_{out}$) for the HSV triplets of the output display data 128. Generally, the intent of the four point transform function 302 (or any other n-point transform function) is to spread the histogram of the input V values of the input display data 126 over the full range (e.g., 0 to $R_{MAX}$) in a way that substantially maximizes contrast for the image. As the name suggest, the four point transform function 302 is primarily characterized by four points P0, P1, P2, and P3 (also identified as points 310, 311, 312, and 313, respectively), which define four regions: dark region 314; medium region 315, bright region 316, and saturation region 317, and whereby the four-point transform function 302 increases substantially monotonically over the corresponding region (i.e., the four-point transform function 302 is discretely linear between points). The point P0 corresponds to the point (Vin0, Vout0), the point P1 corresponds to the point (Vin1, Vout1), the point P2 corresponds to the point (Vin2, Vout2), and the point P3 corresponds to the point (Vin3, Vout3). The four point transform function 302 further is characterized by a fifth point (point 318) that defines the end of the saturation region 317, whereby in this embodiment the point 318 is set to the maximum value (RMAX) for both input and output. Thus, even though the four point transform function 302 technically is composed of five points (n=5), the fifth point 318 is predetermined and therefore it is the four points P0-P3 that primarily define the transform properties, and thus the illustrated transform function is referred to as a "four point transform function" in recognition of the four points P0-P3.

In order to maximize overall image contrast, and thus achieve the greatest reduction in power consumption due to the corresponding decrease in backlight intensity permitted by the increased contrast, it generally is desirable to arrange the four points P0-P3 of the four point transform function such that there is greater contrast at the darker end of the spectrum than at the brighter end of the spectrum. Accordingly, as the slope of the segment of each region represents the degree of contrast of the region, the four point transform function 302 typically is configured such that the slope $M_D$ of the segment of the four point transform function 302 in the dark region 314 is the greatest, followed by the slope $M_M$ of the segment of the four point transform function in the medium region 315, which is followed by the slope $M_B$ of the segment of the four point transform function 302 of the bright region 316 (i.e., $M_D>M_M>M_B$). Further, the segment of the four point transform function 302 in the saturation region 317 has a slope of zero such that all input V values falling within the saturation region 317 have the same output V value, which preferably is set to the maximum V value $R_{MAX}$ (e.g., 255 for an eight-bit V value). That is, all of the input V values falling within the saturation region 317 are saturated at the maximum V value $R_{MAX}$. Example methods for determining the points P0 (Vin0, Vout0), P1 (Vin1, Vout1), P2 (Vin2, Vout2) and P3 (Vin3, Vout3) are described in greater detail below with reference to FIGS. 5-8.

Figure 4:
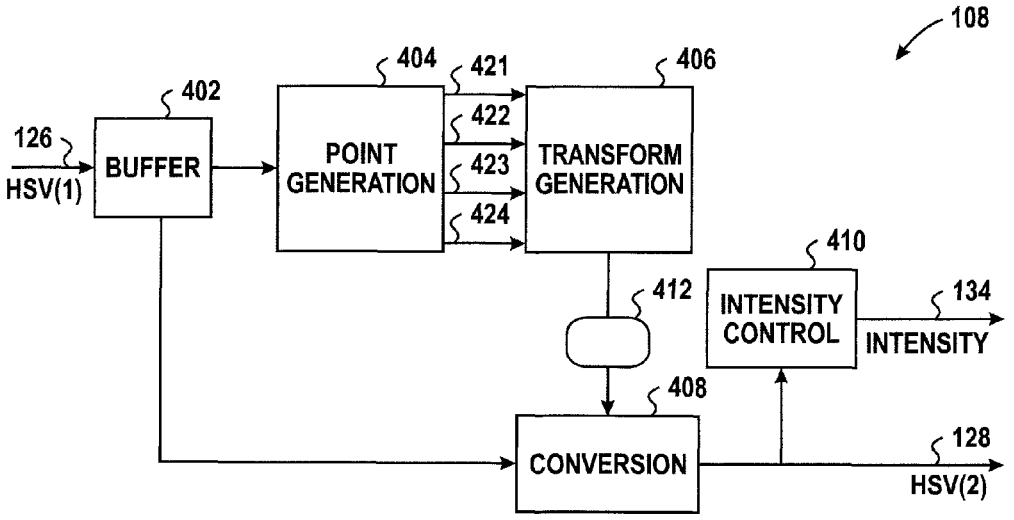
FIG. 4 is a block diagram illustrating an implementation of a transform mapping module of the display system of FIG. 1 in accordance with at least one embodiment of the present disclosure.

FIG. 4 illustrates an example implementation of the n-point mapping module 108 of FIG. 1 in accordance with at least one embodiment of the present disclosure. In the depicted example, the n-point mapping module 108 includes a buffer 402, a point generation module 404, a conversion module 408, and an intensity control module 410. The buffer 402 can include, for example, a frame buffer, field buffer, cache, or memory associated with a central processing unit (CPU) or graphics processing unit (GPU). The modules 404, 406, 408, and 410 can be implemented as software executed by a processing system, via hardware (e.g., an ASIC), firmware, or a combination thereof. To illustrate, these components can be implemented as one or more software routines configured to manipulate one or more processors to perform the ascribed functionality, the components can be implemented as a processor designed based on synthesis of RTL instructions representative of the described functionality, or a combination thereof.

In operation, the V values (hereinafter, "the Vin values") of the HSV triplets represented by input display data 126 of a display frame are buffered in the buffer 402. The point generation module 404 accesses the Vin values in the buffer 402 and uses the Vin values to determine the n points of the corresponding transform function. To illustrate, for generation of the four point transform function 302 of FIG. 3, the n-point mapping module 108 would implement the processes described herein to generate the points P0, P1, P2, and P3 (and the point 318) and provide point representations 421-424 of the points P0, P1, P2, and P3, respectively, to the transform generation module 416. The point representations 421-424 each can represent, for example, a Vin value and a Vout value for the respective point (e.g., (Vin2, Vout2) for point P2). Examples of the processes utilized by the point generation module 404 to generate the corresponding points are described below with reference to FIG. 5.

The transform generation module 406 utilizes the point representations 421-424 to generate the n-point transform function (e.g., the four point transform function 302 of FIG. 3), which can be represented by a data structure 412. The data structure 412 can comprise any of a variety of representations of the n-point transform function. To illustrate, in one embodiment, the data structure 412 can include an index of each input Vin value and the corresponding Vout value. As another example, the data structure 412 can include data representative of a piecewise function representative of the four point transform function. To illustrate, each region can be defined by the function:

$$V_{outs}=m\square(V_{inx}-X_i)+Y_i \qquad \text{EQ. 1}$$

where $V_{inx}$ represents the Vin value to be converted, $V_{outx}$ represents the resulting converted V value, $X_i$ and $Y_i$ represent the abscissa value and the ordinate value of the point $P_i(X_i, Y_i)$ that defines the start of the region, and m represents the slope between the point $P_i$ and the point $P_{i+1}$ that defines the end of the region. The resulting data structure 412 then may be stored at a storage device (e.g., a cache, a memory, a disc drive, a register file, etc.) of the display system 100 (FIG. 1) for subsequent access.

The conversion module 408 uses the n-point transform function represented by the data structure 412 to convert the Vin values in the buffer 402 to corresponding Vout values. To illustrate, if the data structure 412 is in index table form, the conversion module 408 can access the table entry corresponding to a particular Vin value to determine the corresponding Vout value. The generated Vout values can be temporarily buffered in the buffer 402 or in another storage device. The conversion module 408 then combines the Vout values with the original, unchanged H values and the S values of the input display data 126 to generate the modified HSV triplets of the output display data 128.

The intensity control module 410 is configured to analyze the Vout values generated by the conversion module 408 for a display frame so as to determine the average contrast for the display frame based on the Vout values. The following equation represents one function that can be used to determine the average contrast for the display frame:

$$\text{Avg_Contrast}=\left(\frac{Vout1}{Vin1-V0}\right)\sum_{v=V0}^{Vin1}p(v)+\left(\frac{Vout2-Vout1}{Vin2-Vin1}\right)\sum_{v=vin1}^{Vin2}p(v)+\left(\frac{Vout3-Vout2}{Vin3-Vin2}\right)\sum_{v=vin2}^{Vin3}p(v) \qquad \text{EQ. 2}$$

where Avg_Contrast represents the average contrast of the display frame, p(v) represents the number of pixels in the input display data 126 with the V value of (v) and V0 represents the dimmest (i.e., lowest) possible value for the Vin values (typically zero (0)). The function of EQ. 2 represents a function to determine the average contrast in the context of the four regions of the four point transform function 302 of FIG. 3, but the same functional structure can be expanded to determine the average contrast over the n−1 regions of any of a variety of n-point transform functions. The intensity control module 410 then provides the determined average contrast for the display frame as the backlight control signal 134, which is used to control the backlight intensity of the backlight 118 (FIG. 1) as described herein.

Figure 5:
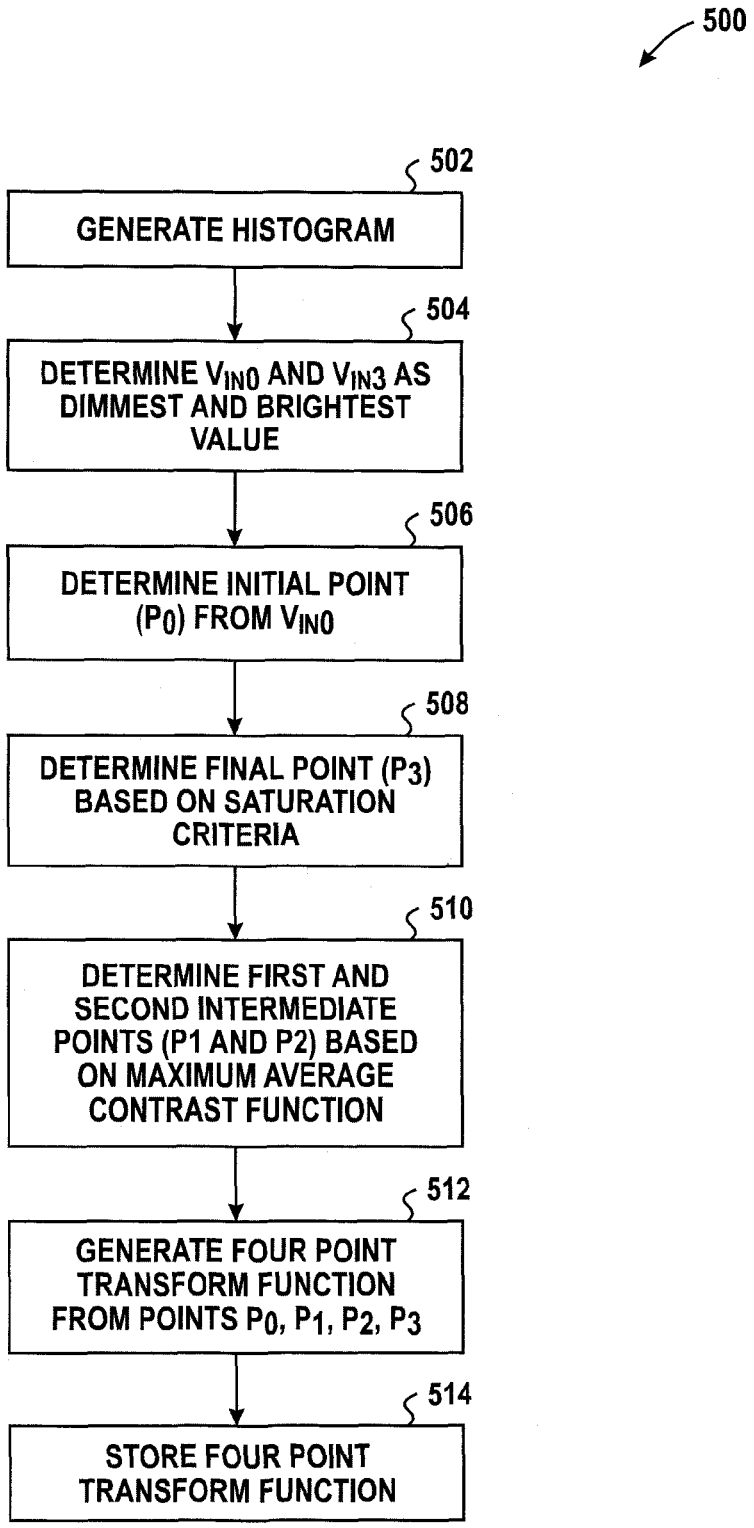
FIG. 5 is a flow diagram illustrating a method for determining a four point transform function in accordance with at least one embodiment of the present disclosure.

FIG. 5 illustrates an example method 500 for determining the four points P0, P1, P2, and P3 for the four point transform function 302 of FIG. 3 in accordance with at least one embodiment of the present disclosure. At block 502, the n-point mapping module 108 receives a set of Vin values of the HSV triplets representative of a set of pixels (e.g., a display frame) and generates a histogram of the set of Vin values. At block 504, the n-point mapping module 108 identifies the dimmest (e.g., lowest valued) Vin value as Vin0. At block 506, the n-point mapping module 108 identifies Vout0, and thus the initial point P0=(Vin0, Vout0) based on Vin0. In one embodiment, Vout0 is set so as to be proportional to the minimum brightness, such as by using the following equation:

$$Vout0 = \frac{Vin0^2}{R\max} \qquad \text{EQ. 3}$$

where Rmax represents the maximum range of the V values (e.g., 255 for an eight-bit V value).

At block 508, the n-point mapping module 108 determines the final (calculated) point P3=(Vin3, Vout3) based on a predetermined saturation criterion provided by a user, a designer, and the like. To illustrate, a user or designer may provide an indication of a desired fidelity factor (i.e., the amount or percentage of pixels permitted to become saturated). Because the final point P3 demarks the point at which all pixels beyond Vin3 of point P3 become saturated, Vin3 for the final point P3 is selected consistent with the fidelity factor (i.e., such that the number of Vout values that are saturated does not exceed the desired fidelity factor). To illustrate, if the fidelity factor is 97%, then Vin3 is selected such that 97% of the Vin values are less than Vin3. Vout3 for the final point P3 is set to the saturation value, or Rmax (e.g., 255 for an eight-bit V value).

At block 510, the n-point mapping module 108 determines the first intermediate point P1 and the second intermediate point P2 so as to maximize the average contrast of the dark region 314 and the medium region 315 (FIG. 3) of the resulting four point transform function 302. In at least one embodiment, the n-point mapping module 108 further verifies that the determined first and second intermediate points P1 and P2 meet certain criteria to ensure that the resulting four point transform is not improperly utilized so as to further degrade the image.

Figure 6:
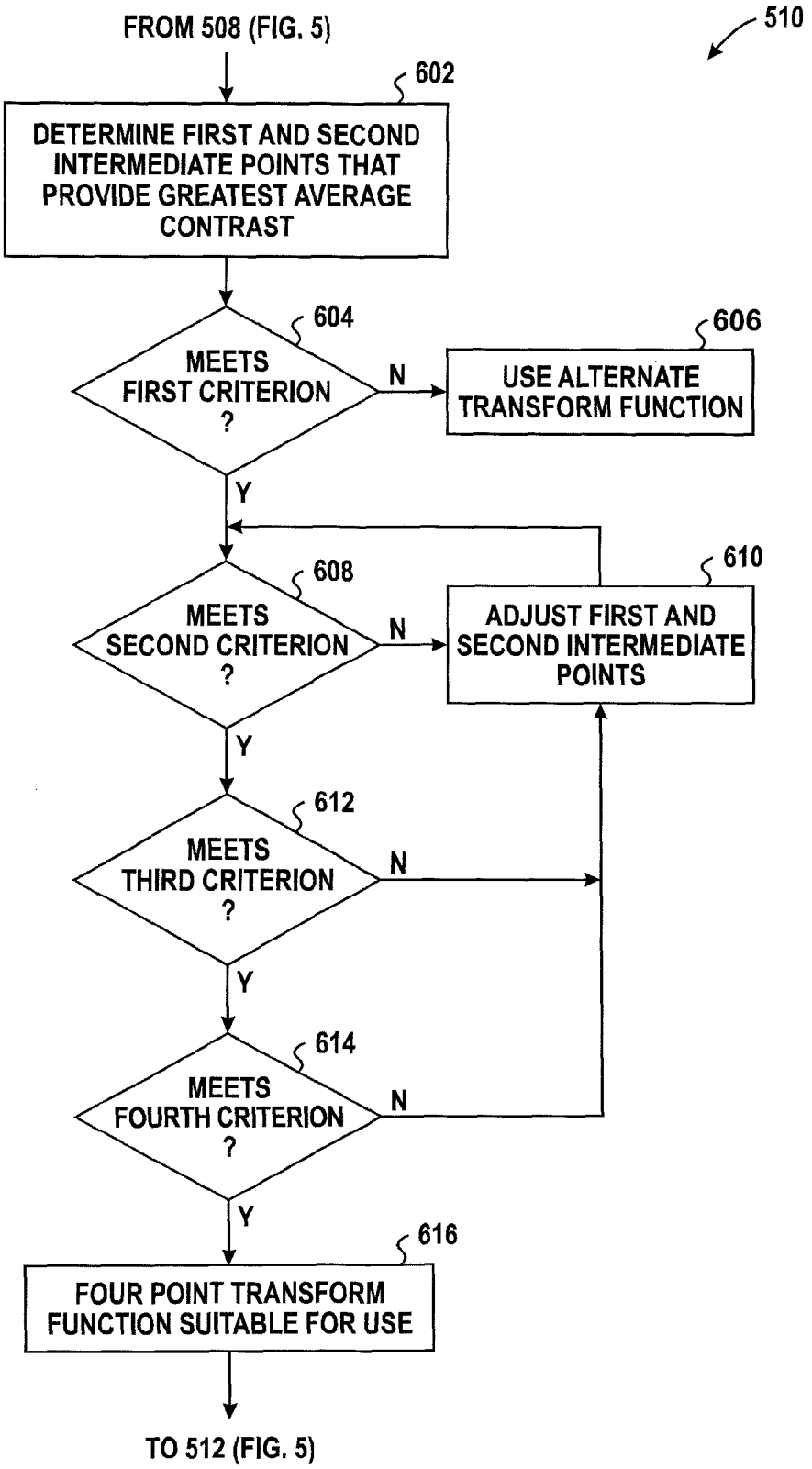
FIG. 6 is a flow diagram illustrating a method for verifying a four point transform function based on one or more criteria in accordance with at least one embodiment of the present disclosure.

Referring to FIG. 6, an exemplary implementation of the process of block 510 is illustrated in accordance with at least one embodiment of the present disclosure. At block 602, the n-point mapping module 108 determines the values Vin1, Vout1, Vin2, and Vout2 of points P1 and P2 by selecting initial values for Vin1, Vout1, Vin2, Vout2 and then iteratively adjusting Vin1, Vout1, Vin2, Vout2 based on a maximum average contrast function which serves to substantially maximize the average contrast of a display frame converted by the resulting four point transform function. An example maximum average contrast function is illustrated by the equation below, whereby the values Vin1, Vout1, Vin2, Vout2 are iteratively adjusted until the result of the following equation is maximized:

$$\text{MAX}\left\{\begin{array}{l}\left(\frac{Vout1}{Vin1 - V0}\right)\sum_{v=V0}^{Vin1} p(v) + \left(\frac{Vout2 - Vout1}{Vin2 - Vin1}\right) \\ \sum_{v=vin1}^{Vin2} p(v) + \left(\frac{Vout3 - Vout2}{Vin3 - Vin2}\right)\sum_{v=vin2}^{Vin3} p(v)\end{array}\right\} \qquad \text{EQ. 4}$$

where p(v) represents the number of pixels in the input display data 126 with the V value of (v) and V0 represents the dimmest (i.e., lowest) possible value for the Vin values (typically zero (0)). It will be appreciated that EQ. 4 calculates the contrast enhancement in each of the three non-saturation regions (by calculating the slope of the function within the region) and then weights the contrast enhancement in each region by the number of pixels in each region. Further, EQ. 4 seeks to maximize the total contrast enhancement across all three non-saturation regions. Although EQ. 4 illustrates one example of the maximum average contrast function, any of a variety of similar functions which serve to approximately maximize the average contrast of the resulting display frame can be implemented without departing from the scope of the present disclosure.

The values for Vin0, Vout0, Vin1, Vout1, Vin2, Vout2, Vin3, and Vout3 being determined, the n-point mapping module 108 is able to construct a tentative four point transform function. However, before this tentative four point transform function can be implemented as an actual four point transform function, the n-point mapping module 108 is configured to verify that one or more criteria are met by the tentative four point transform function. In the following, the tentative four point transform function is analyzed to determine whether four example criteria are met. Although a particular order for analyzing the criteria is described, any order of analysis can be implemented without departing from the scope of the present disclosure.

A first criterion assessed by the n-point mapping module 108 includes verifying that the V values are not concentrated in only one or two adjacent regions of the transform and thus reducing the benefit of implementing a four point transform function. Accordingly, at block 604 the n-point mapping module 108 analyzes the histogram of the input Vin values (determined at block 502) in view of the tentative four point transform function to determine whether the combined V value populations of one or two adjacent regions of the regions 314-317 (FIG. 3) of the tentative four point transform function does not exceed a predetermined threshold proportion of the total number of V values for the display data. The predetermined threshold can range from, for example, 50% to 100%. To illustrate, if the threshold is set to 100% and all of the V values are found in, for example, the medium region 315 and the bright region 316, then the tentative four point transform function is identified as failing to meet the criterion that the V values be at least minimally distributed among all four regions 314-317.

In the event that the combined population of one or two adjacent regions exceeds the threshold (and thus the V values are not sufficiently distributed), at block 606 an alternate conventional transform function can be utilized in place of a four point transform function to convert the Vin values to corresponding Vout values, or no conversion may be performed. The remaining processing of the resulting display proceeds as described herein.

Otherwise, if the V values are sufficiently distributed across the tentative four point transform function, at block 608 the n-point mapping module 108 determines whether the tentative four point transform function meets a second criterion. In one embodiment, the second criterion is met when each of the following relationships are met:

$$Vout1 \geq Vin1 \quad \text{EQ. 5}$$

$$Vout2 \geq Vin2 \quad \text{EQ. 6}$$

$$\frac{\frac{Vout1}{(Vin1 - Vin0)}}{\frac{(R\max - Vout2)}{(Vin3 - Vin2)}} \leq Thresh2 \quad \text{EQ. 7}$$

where Thresh2 is a predetermined threshold value (e.g., four (4)).

In the event that the second criterion is not met, at block 610 the values of Vin1, Vout1, Vin2, Vout2 are adjusted (e.g., incremented or decremented by a predetermined amount) so as to adjust the tentative four point transform function. The flow of the process then returns to block 608 whereby the n-point mapping module 108 analyzes the tentative four point transform function, as adjusted, to verify whether it meets the second criterion. The process of blocks 608 and 610 can be repeated until the second criterion is met.

In the event that the tentative four point transform function meets the second criterion, at block 612 the n-point mapping module 108 determines whether the tentative four point transform function meets a third criterion. In one embodiment, the third criterion is met when each of the following relationships are met:

$$\frac{P_B}{P_D} \leq \frac{M_B}{M_D} \quad \text{EQ. 8}$$

$$\frac{P_M}{P_D} \leq \frac{M_M}{M_D} \quad \text{EQ. 9}$$

$$\frac{P_B}{P_M} \leq \frac{M_B}{M_M} \quad \text{EQ. 10}$$

$$M_D \geq M_M \quad \text{EQ. 11}$$

$$M_D \geq M_B \quad \text{EQ. 12}$$

whereby $M_D$ represents the slope of the segment of the tentative four point transform function in the dark region 314, $M_M$ represents the slope of the segment of the tentative four point transform function in the medium region 315, and $M_B$ represents the slope of the segment of the tentative four point transform function in the bright region 316, and whereby $P_D$ represents the population of Vin values in the dark region 314, $P_M$ represents the population of Vin values in the medium region 315, and $P_B$ represents the population of Vin values in the bright region 316.

In the event that the third criterion is not met, the flow returns to block 610, whereby the values of Vin1, Vout1, Vin2, and Vout2 are adjusted so as to adjust the tentative four point transform function. The process of blocks 608, 610, and 612 can be repeated until the second criterion and the third criterion are met.

In the event that the tentative four point transform function meets the third criterion, at block 614 the n-point mapping module 108 determines whether the tentative four point transform function meets a fourth criterion. In one embodiment, the fourth criterion is that the medium region 316 is substantially undistorted (i.e., the slope $M_M$ of the medium region 316 is not less than one (1)). This criterion can be determined to be met when either of the following relationships is met:

$$M_M \geq 1 \quad \text{EQ. 13}$$

$$\frac{P_M + P_B}{P_D} \leq \frac{M_M}{M_D} \quad \text{EQ. 14}$$

whereby $M_M$ represents the slope of the segment of the tentative four point transform function in the medium region 315, $P_D$ represents the population of Vin values in the dark region 314, $P_M$ represents the population of Vin values in the medium region 315, and $P_B$ represents the population of Vin values in the bright region 316.

In the event that the fourth criterion is not met, the flow returns to block 610, whereby the values of Vin1, Vout1, Vin2, Vout2 are adjusted so as to adjust the tentative four point transform function. The process of blocks 608, 610, 612, and 614 can be repeated until the second criterion and the third criterion are met.

In the event that the tentative four point transform function meets the fourth criterion, at block 616 the n-point mapping module 108 has verified that the four example criteria have been met by the tentative four point transform function and the tentative four point transform function therefore is suitable for use. Accordingly, the flow then proceeds to block 512 of method 500.

Returning to method 500 of FIG. 5, at block 512 the n-point mapping module generates the data structure 412 (FIG. 4) representative of the four point transform function 302 based on the values Vin0, Vout0, Vin1, Vout1, Vin2, Vout2, Vin3, and Vout3 of points P0, P1, P2, and P3 as determined at blocks 504-510. At block 514 the data structure 412 is then stored at a storage device (e.g., a cache, a memory, or a register file) for use in converting the Vin values of the input display data 126 to the corresponding Vout values of the output display data 128 as described herein.

Figure 7:
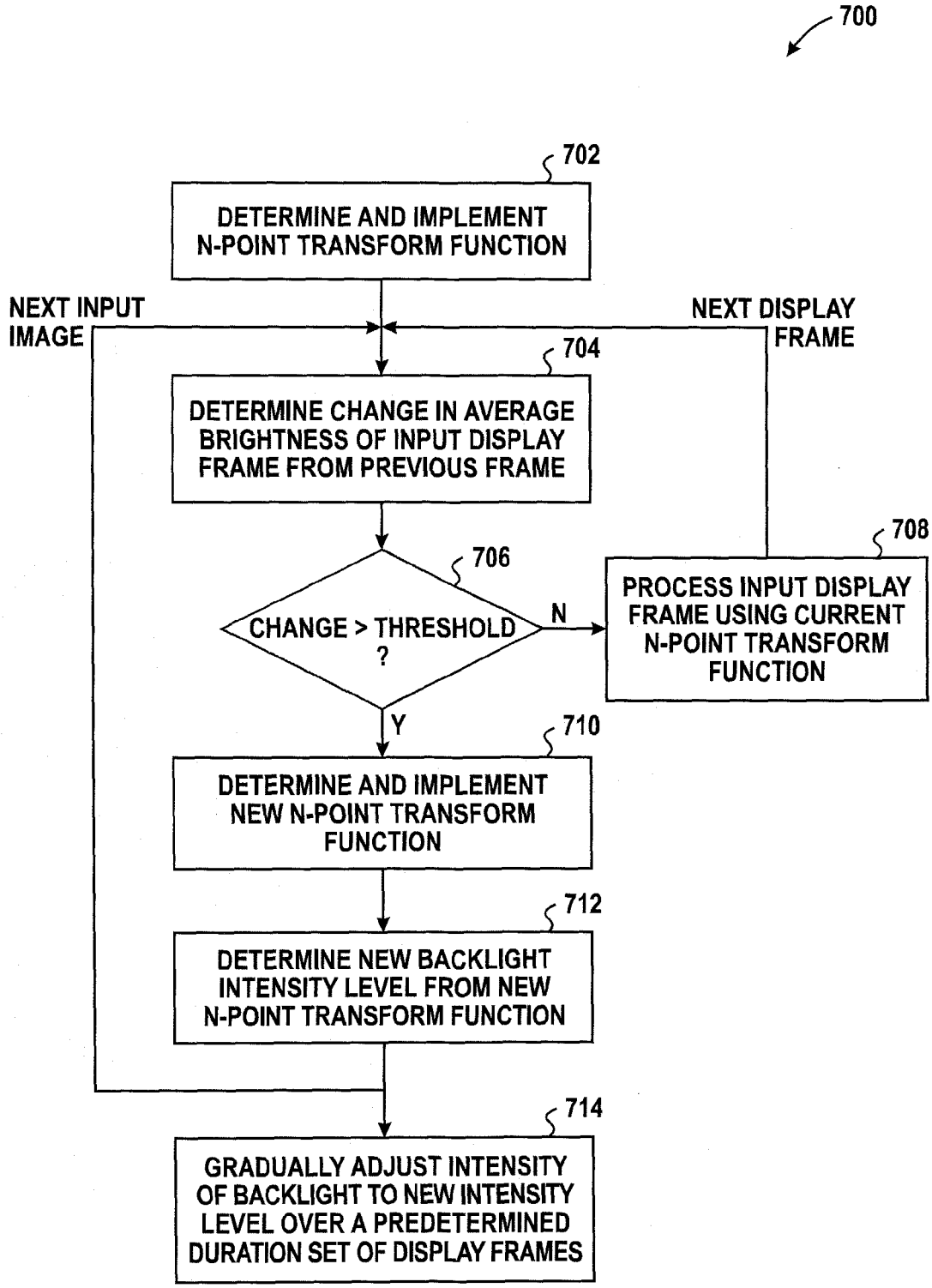
FIG. 7 is flow diagram illustrating a method for adjusting a backlight intensity in accordance with at least one embodiment of the present disclosure.

FIG. 7 illustrates an example method 700 for controlling the intensity of the backlight 118 of the display system 100 of FIG. 1 based on the contrast enhancement provided by application of an n-point transform function in accordance with at least one embodiment of the present disclosure.

A process for determining and implementing an n-point transform function based on the Vin values of a display frame was described above. While in certain embodiments this process can be repeated for each incoming display frame, it will be appreciated that such implementation is processing intensive. Accordingly, rather than implement a new four point transfer function for each incoming display frame, the same four point transfer function can be implemented for a series of display frames until a situation is encountered that stimulates the use of a new four point transform.

Accordingly, at block 702 the n-point mapping module 108 determines and implements an initial n-point transform function based on the first display frame processed for an incoming video stream. The initial n-point transform function then can be used to convert the V values for one or more successive display frame until a certain condition occurs, at which point a new n-point transform function can be determined. In one embodiment, it may be advantageous to maintain the same n-point transform function until the brightness from one display frame to the next increases or decreases significantly (e.g., due to a scene change). Accordingly, at block 704 the n-point mapping module 108 determines the change in average brightness from the previously processed display frame to the incoming display frame to be processed, whereby the average brightness for a display frame is represented by the average V value of the display frame (e.g., the sum of all of the V values of the display frame divided by the total number of V values in the display frame). At block 706, the n-point mapping module 108 compares the change in average brightness to a predetermined threshold. If the change in average brightness does not exceed the threshold, at block 708 the incoming display frame is processed using the current n-point transform function as described above. Otherwise, if the change exceeds the threshold, at block 710 the n-point mapping module 108 determines and implements a new n-point transform function using the Vin values of the incoming display frame as described above.

Further, at block 712, the n-point mapping module 108 determines a new intensity level for the backlight 118 based on the new n-point transform function determined at block 712. In one embodiment, the new intensity level is calculated as the ratio of the total brightness of the transformed display frame (e.g., the sum of the Vout values of the transformed display frame) to the total brightness of the original display frame (e.g., the sum of the Vin values of the input display frame).

After determining the new intensity level, the n-point mapping module 108 signals the backlight controller 120 (FIG. 1) to adjust the intensity of the backlight 118 using the backlight control signal 134. Although the n-point mapping module 108 could signal the backlight controller 120 to immediately adjust the intensity of the backlight 118 to the new intensity level, such rapid adjustments to backlight intensity can introduce undesirable flickering at the display 114 (FIG. 1). Accordingly, rather than increase or decrease the backlight intensity immediately to the new intensity level, at block 714 the n-point mapping module 108 signals the backlight controller 120 to gradually adjust the intensity of the backlight 118 to the new intensity level over a predetermined number of display frames or a predetermined duration. To illustrate, n-point mapping module 108 could manipulate the backlight controller 120 to gradually adjust the backlight 118 to the new intensity level over, for example, ten display frames. As such, the potential for flickering due to changes in the backlight intensity can be reduced.

In addition to hardware implementations adapted to perform the functionality in accordance with one of the embodiments of the present disclosure, such devices may also be embodied in software disposed, for example, in a computer usable (e.g., readable) medium configured to store the software (e.g., a computer readable program code). The program code causes the enablement of embodiments of the present invention, including the following embodiments: (i) the functions of the systems and methods disclosed herein (such as systems and methods detecting display and/or accessory connection and/or accessory class); (ii) the fabrication of the systems and methods disclosed herein (such as the fabrication of devices that are enabled to detect display and/or accessory connection and/or accessory class); or (iii) a combination of the functions and fabrication of the systems and methods disclosed herein.

For example, this can be accomplished through the use of general programming languages (such as C or C++), hardware description languages (HDL) including Verilog, Verilog-A, HDL, VHDL, Altera HDL (AHDL) and so on, or other available programming and/or schematic capture tools (such as circuit capture tools). The program code can be disposed in any known computer usable medium including semiconductor, magnetic disk, optical disk (such as CD-ROM, DVD-ROM) and as a computer data signal embodied in a computer usable (e.g., readable) transmission medium (such as a digital, optical, or analog-based medium). It is understood that the functions accomplished and/or structure provided by the systems and techniques described above can be represented in a core (such as a GPU core) that is embodied in program code and may be transformed to hardware as part of the production of integrated circuits.

Figure 8:
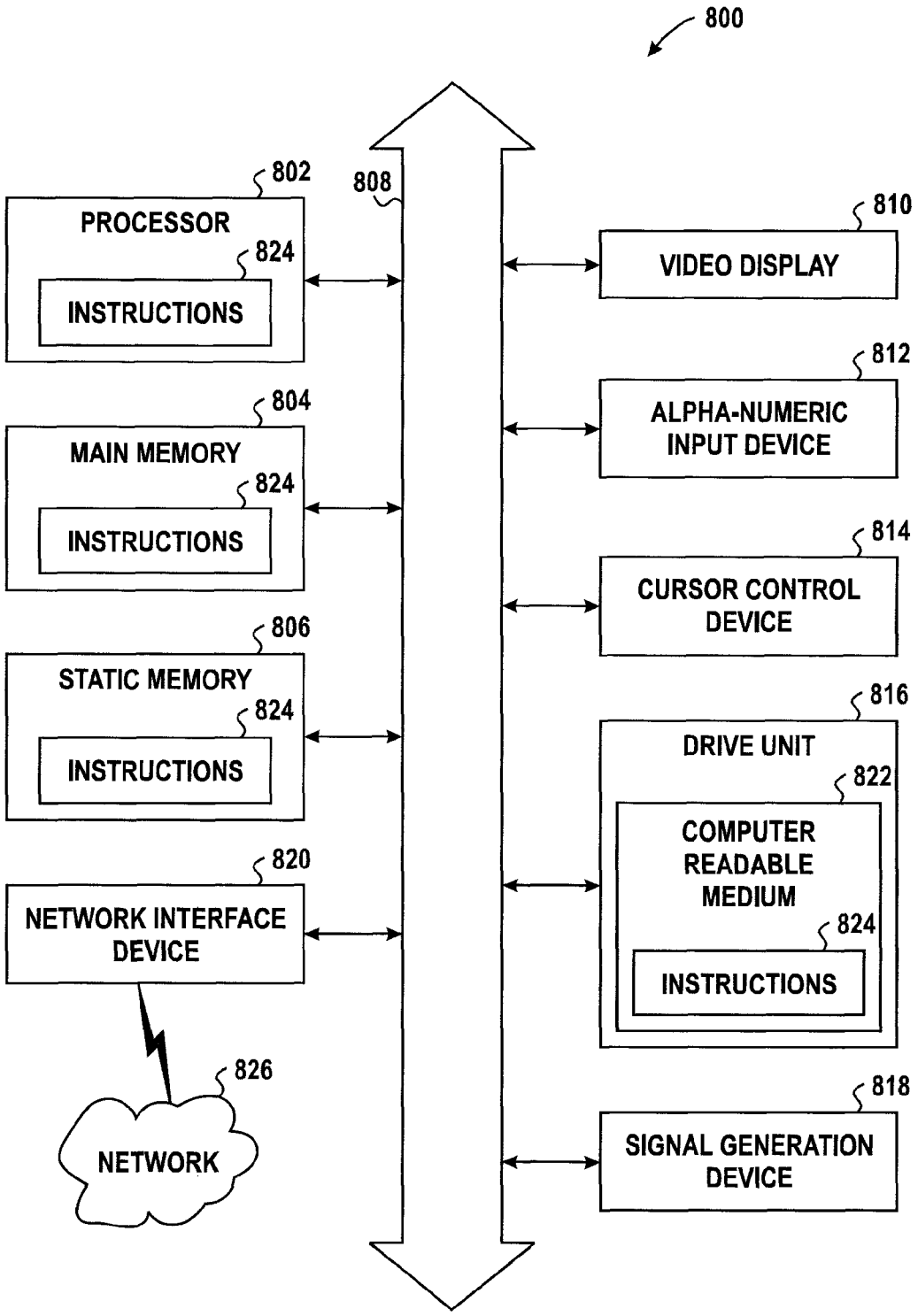
FIG. 8 is a diagram illustrating an example processing system for implementing a display system in accordance with at least one embodiment of the present disclosure.

FIG. 8 illustrates a processing system 800 in accordance with at least one embodiment of the present disclosure. The processing system 800 can include a set of instructions that can be executed to manipulate the processing system 800 to perform any one or more of the methods or functions disclosed herein. The processing system 800 may operate as a standalone device or may be connected, e.g., using a network, to other processing systems or peripheral devices.

In a networked deployment, the processing system may operate in the capacity of a server or as a client user computer in a server-client user network environment, or as a peer processing system in a peer-to-peer (or distributed) network environment. The processing system 800 can also be implemented as or incorporated into, for example, a portable display device. Further, while a single processing system 800 is illustrated, the term "system" shall also be taken to include any collection of systems or sub-systems that individually or jointly execute a set, or multiple sets, of instructions to perform one or more computer functions.

The processing system 800 may include a processor 802, e.g., a central processing unit (CPU), a graphics processing unit (GPU), or both. Moreover, the processing system 800 can include a main memory 804 and a static memory 806 that can communicate with each other via a bus 808. As shown, the processing system 800 may further include a video display unit 810, such as a liquid crystal display (LCD), an organic light emitting diode (OLED), a flat panel display, a solid state display, or a cathode ray tube (CRT). Additionally, the processing system 800 may include an input device 812, such as a keyboard, and a cursor control device 814, such as a mouse. The processing system 800 can also include a disk drive unit 816, a signal generation device 818, such as a speaker, and a network interface device 820.

In a particular embodiment, as depicted in FIG. 8, the disk drive unit 816 may include a computer readable storage device 822 in which one or more sets of instructions 824, e.g. software, can be embedded. Further, the instructions 824 may embody one or more of the methods or logic as described herein. In a particular embodiment, the instructions 824 may reside completely, or at least partially, within the main memory 804, the static memory 806, and/or within the processor 802 during execution by the processing system 800. The main memory 804 and the processor 802 also may include computer readable media. The network interface device 820 can provide connectivity to a network 826, e.g., a wide area network (WAN), a local area network (LAN), or other network.

In an alternative embodiment, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and processing systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented, in whole or in part, by software programs executable by a processing system. The present disclosure contemplates a computer readable storage device that includes instructions or receives and provides instructions for execution responsive to a propagated signal, so that a device connected to a network can communicate voice, video or data over the network 826. Further, the instructions 824 may be transmitted or received over the network 826 via the network interface device 820.

In one embodiment, rather than being software instructions that directly implement the functionality described herein, the instructions 824 instead can implement design instructions representative of a hardware implementation of the above-described functionality that are then synthesized to determine the electrical and electronic design for a processing device that implements the above-described invention. To illustrate, these hardware-design instructions can include register transfer level (RTL) instructions, Verilog instructions, and the like.

While the computer readable storage device is shown to be a single storage device, the term "computer readable storage device" includes a single storage device or multiple storage devices, such as a centralized or distributed database, and/or associated caches and servers that store one or more sets of instructions. The term "computer readable storage device" shall also include any storage device that is capable of storing a set of instructions for execution by a processor or that cause a processing system to perform any one or more of the methods or operations disclosed herein.

In a particular non-limiting, exemplary embodiment, the computer readable storage device can include a solid-state memory such as a memory card or other package that houses one or more non-volatile read-only memories. Further, the computer readable storage device can be a random access memory or other volatile re-writeable memory. Additionally, the computer readable storage device can include a magneto-optical or optical medium. Accordingly, the disclosure is considered to include any one or more of a computer readable storage device or a distribution medium and other equivalents and successor media, in which data or instructions may be stored.

In this document, relational terms such as "first" and "second", and the like, may be used solely to distinguish one entity or action from another entity or action without necessarily requiring or implying any actual such relationship or order between such entities or actions. The terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A method comprising:

determining n points that define n−1 regions of a first transform function based at least in part on a first set of values associated with a first display frame and a maximum average contrast function, n being an integer greater than 2;

converting the first set of values to a corresponding second set of values based on the first transform function; and generating a backlight control signal based on an average contrast of the second set of values, the backlight control signal configured to control an intensity of a backlight of a display.

2. The method of claim 1, further comprising:

generating a video signal based on the second set of values, the video signal configured to drive a display.

3. The method of claim 1, wherein determining the n points that define the n−1 regions of the first transform function comprises determining the n points in response to a change in an average contrast of the first display frame compared to an average contrast of a previous display frame exceeding a predetermined threshold.

4. The method of claim 1, further comprising:

generating the first set of values based on a third set of values associated with the display frame, the first set of values having a first color space and the third set of values having a second color space.

5. The method of claim 4, wherein:

the first color space comprises a Hue-Saturation-Value (HSV) color space and the second color space comprises a Red-Green-Blue (RGB) color space; and the first set of values comprises value (V) values in the HSV color space.

6. The method of claim 1, wherein generating the backlight control signal comprises generating the backlight control signal to gradually adjust the intensity of the backlight over one of a predetermined duration or a predetermined number of display frames.

7. The method of claim 1, wherein determining the n points of the first transform function comprises:

determining an initial point of the n points based on the darkest value of the first set of values; and determining a final point of the n points based on a saturation criterion.

8. The method of claim 7, wherein determining the n points of the first transform further comprises:

determining a first intermediate point and a second intermediate point of the n points of the first transform function based on the initial point, the final point, and an iterative application of the maximum average contrast function.

9. The method of claim 8, wherein determining the first intermediate point and the second intermediate point comprises:

determining the first intermediate point and the second intermediate point based on one or more iterative applications of the maximum average contrast function until each of one or more predefined criteria are met based on the resulting first intermediate point and the second intermediate point.

10. The method of claim 9, wherein the one or more predefined criteria includes at least one selected from a group consisting of: a criterion that is met when a slope of a segment of the first transform function defined by the first point and the first intermediate point is the greatest slope of the first transform function; and a criterion that is met when a ratio of populations of values in each region is not greater than a ratio of slopes of segments of the first transform function defined by the n points.

11. A system comprising:

a hardware mapping module comprising:

a point generation module configured to determine n points that define n−1 regions of a first transform function based at least in part on a first set of values associated with a first display frame and a maximum average contrast function, n being an integer greater than two;

a conversion module configured to convert the first set of values to a second set of values based on the first transform; and an intensity control module configured to generate a backlight control signal based on an average contrast of the second set of values, the backlight control signal configured to control an intensity of a backlight of a display.

12. The system of claim 11, further comprising:

a backlight controller configured to operate the backlight of the display based on the backlight of control signal.

13. The system of claim 11, wherein the point generation module is configured to determine the n points of the first transform function by:

determining an initial point of the n points based on the darkest value of the first set of values; and determining a final point of the n points based on a saturation criterion.

14. The system of claim 13, wherein the point generation module is configured to determine the n points of the first transform by determining a first intermediate point and a second intermediate point of the n points of the first transform function based on an iterative application of the maximum average contrast function using the initial point and the final point.

15. The system of claim 14, wherein the point generation module is configured to determine the first intermediate point and the second intermediate point based on one or more iterative applications of the maximum average contrast function until each of one or more predefined criteria are met based on the resulting first intermediate point and the second intermediate point.

16. The system of claim 15, wherein the one or more predefined criteria comprises at least one selected from a group consisting of: a criterion that is met when a slope of a segment of the first transform function defined by the first point and the first intermediate point is the greatest slope of the first transform function; and a criterion that is met when a ratio of populations of values in each region is not greater than a ratio of slopes of segments of the first transform function defined by the n points.

17. A computer readable memory storing data representative of a set of instructions, the set of instructions configured to manipulate one or more processors to:

determine n points that define n−1 regions of a first transform function based at least in part on a first set of values associated with a first display frame and a maximum average contrast function, n being an integer greater than two;

convert the first set of values to a second set of values based on the first transform; and generate a backlight control signal based on an average contrast of the second set of values, the backlight control signal configured to control an intensity of a backlight of a display.

18. The computer readable memory of claim 17, wherein the set of instructions is configured to manipulate the one or more processors to determine the n points of the first transform function by manipulating the one or more processors to:

determine an initial point of the n points based on the darkest value of the first set of values; and determine a final point of the n points based on a saturation criterion.

19. The computer readable memory of claim 17, wherein the set of instructions is configured to manipulate the one or more processors to determine the n points of the first transform function by manipulating the one or more processors to:

determine a first intermediate point and a second intermediate point of the n points of the first transform function based on an iterative application of the maximum average contrast function using the initial point and the final point.

20. The computer readable memory of claim 17, wherein the set of instructions comprises register transfer level (RTL) instructions configured to determine a design of the one or more processors.

* * * * *